US007070068B2

(12) United States Patent
Fox

(10) Patent No.: US 7,070,068 B2
(45) Date of Patent: Jul. 4, 2006

(54) POST-MIX BEVERAGE DISPENSER FOR CREATING FROTHED BEVERAGES

(76) Inventor: David Fox, 4174 Alonzo Ave., Encino, CA (US) 91316

( * ) Notice: Subject to any disclaimer, the term of this patent is extended or adjusted under 35 U.S.C. 154(b) by 0 days.

(21) Appl. No.: 11/004,466

(22) Filed: Dec. 3, 2004

(65) Prior Publication Data

US 2005/0082313 A1 Apr. 21, 2005

Related U.S. Application Data

(63) Continuation-in-part of application No. 10/454,453, filed on Jun. 3, 2003, now Pat. No. 6,871,761.

(51) Int. Cl.
*B67B 7/00* (2006.01)

(52) U.S. Cl. ..... 222/129.1; 222/145.5; 99/323.2; 366/165.1; 366/165.4

(58) Field of Classification Search ..... 222/129.1
See application file for complete search history.

(56) References Cited

U.S. PATENT DOCUMENTS 4,676,401 A 6/1987 Fox et al.
4,808,346 A 2/1989 Strenger
4,922,810 A 5/1990 Siccardi
5,000,351 A 3/1991 Rudick
5,269,442 A * 12/1993 Vogel ..... 222/129.1
5,570,822 A 11/1996 LeMarbe et al.
5,685,639 A * 11/1997 Green ..... 366/101
5,938,327 A 8/1999 Benskin et al.
5,980,969 A 11/1999 Mordini et al.
6,305,269 B1 10/2001 Stratton
2005/0072799 A1* 4/2005 Stratton ..... 222/129.1

* cited by examiner

*Primary Examiner*—J. Casimer Jacyna

(74) *Attorney, Agent, or Firm*—Aaron T. Borrowman; Kelly Lowry & Kelley, LLP

(57) ABSTRACT

A post-mix beverage dispenser includes a jet, in fluid communication with a source of non-carbonated diluent, extending into a mixing chamber of the dispenser. The jet includes an aperture, typically in a sidewall thereof, configured to spray the diluent towards the wall of the mixing chamber. A diffuser is disposed below the jet. The diffuser may be in fluid communication with a concentrate dispensing outlet so as to emit concentrate into the mixing chamber. The diluent and concentrate collide in the mixing chamber to create a frothed beverage.

31 Claims, 9 Drawing Sheets

POST-MIX BEVERAGE DISPENSER FOR CREATING FROTHED BEVERAGES

RELATED APPLICATION

This application is a continuation-in-part application of U.S. patent application Ser. No. 10/454,453, filed on Jun. 3, 2003 now U.S. Pat. No. 6,871,761.

BACKGROUND OF THE INVENTION

The present invention generally relates to beverage dispensers. More particularly, the present invention relates to a post-mix beverage dispenser for agitated or whipped beverages.

There are presently a number of popular beverages sold in restaurants, snack shops, amusement parks, fast food outlets, and other establishments throughout the world. Some of these beverages are served in a whipped or foamed condition. That is, the beverage is agitated or whipped in the dispensing process to give the served beverage a foamy, froth texture. Typically, these beverages are made from a combination of a concentrate and a diluent, usually water. The concentrate by itself generally does not require refrigeration and has a shelf life of several months to over a year.

For years, two basic type of fountain dispensers have been available to the trade, referred to respectively as "pre-mix" and "post-mix" dispensers.

Pre-mix dispensers require syrup concentrate and water to be pre-mixed to provide a finished beverage which is then stored in a holding tank until dispensed through a faucet located on the dispenser. However, such pre-mix dispensers suffer from a number of disadvantages. Pre-mixing the syrup and water requires employee time and resources. Even with refrigeration, some bacterial growth is present. Consequently, after a period of time, typically a few days, any remaining pre-mix beverage should be discarded to maintain healthful quality and pleasing beverage taste. Thus, it is necessary to disassemble and clean the whipping assembly on a daily basis to remove accumulated beverage residue remaining in the dispensing apparatus.

Post-mix dispensers do not pre-mix the syrup and water, saving the manual mixing time and employee resources. Instead, the syrup and water are conveyed by separate conduits to a dispenser head, sometimes referred to as a valve, and then mixed while being dispensed through the usual spout on the housing. The syrup may be stored remotely from the dispenser housing in a metallic cylinder, or in a collapsible plastic bag in a cardboard box, or any other suitable storage medium. The water source may simply be the available municipal water line. Post-mix dispensers overcome, to a great extent, the disadvantages suffered by the pre-mix dispensers. Accordingly, the majority of soft drinks and non-carbonated beverages sold in restaurants and fast-food businesses utilize post-mix dispensers.

A conventional post-mix beverage dispenser, referred to by the reference number 10, is illustrated in FIGS. 1 and 2. The beverage dispenser illustrated in FIGS. 1 and 2 is similar to that provided by Cornelius under the UF-1 designation. Other companies provide similar post-mix beverage dispensers operating under generally the same principles and having very similar components.

Referring now to FIGS. 1 and 2, a dispenser head 12 is shown which extends from a support structure (not shown) which, as is well-known in the art that, can accommodate ice and includes fluid conduits to a source of water or other diluent and beverage concentrates, as well as typically accommodating a plurality of dispenser heads. Such support structures typically include a drain basin for collecting spilled beverage and ice, and have a grate 14 for supporting cups 16 thereon so that the cups 16 can be positioned below the dispenser head 12 to receive the beverage 18.

With particular reference to FIG. 2, the dispenser head 12 includes a cover 20, shown in phantom, which houses the necessary components and conduits for dispensing a diluent, typically water, and a syrup or concentrate. As such, the head 12 includes inlet conduits 22 which are connected to fluid lines extending to either the water source or the source of concentrate. Flow regulators 24 are used to adjust the amount of water or concentrate delivered. A switch 26, such as the illustrated push-button switch, electrically activates a solenoid 28 which creates a magnetic field causing an arm 30 to move against the bias of spring 32 and open valves to allow the water and concentrate to flow into a mixing chamber. The dispenser head 12 may include other conduits and chambers for electrical lines, concentrate and diluent passageways, motors as necessary, etc. These components are traditional and well-known in the art.

A generally cylindrical wall 36 extends downwardly from a bottom portion of the dispenser head 12. The spout 34 is attached to the head 12 by a twist-turn frictional fit so that it is removably attached to the head 12 for cleaning purposes and the like. The spout 34 may include a protrusion 38 which is inserted bayonet-style into a mating notch and groove (not shown) such that upon inserting and turning the spout 34 a quarter-turn, it is locked in place. Typically, the spout 34 is defined by generally cylindrical upper portion 40, which tapers at a lower portion 42 thereof to an outlet 44 through which the beverage 18 is dispensed.

In conventional soft drink dispensers, syrup concentrate and pressurized carbon dioxide mixed with water are dispensed through the dispenser head 12 such that the carbonated water falls substantially directly downwardly over a diffuser through which the syrup concentrate is emitted such that the carbonated beverage 18 mixes as the syrup and carbonated water fall through the spout 34 and into the cup 16.

With reference now to FIGS. 2–4, the diffusers 46 conventionally used typically include a hollow post 48 having an O-ring or the like 50 for insertion directly into the syrup concentrate outlet of the dispenser head 12. In one form, the diffuser 46 includes a skirt 52 having apertures 54 which extend into the hollow tube 48 such that the concentrate is ejected from the apertures 54. Grooves or canals 56 can also be implemented to direct the concentrate emitted from the apertures 54. Alternatively, as illustrated in FIG. 4, apertures 60 are formed at a closed end of the hollow tube 48.

The diffusers 46 and 58 also include two or more rings 62 and 64 having a plurality of apertures 66 formed therethrough. The skirt 52 and two or more rings 62 and 64 are of the same diameter. It is well known that when creating carbonated drinks foam is undesirable. The carbonated water tends to foam as it is released into the cup. Accordingly, prior art diffusers, such as diffusers 46 and 58, include a plurality of skirts and rings 52, 62 and 64 so as to reduce the foaming as much as possible. In fact, other prior art diffusers include three or even four rings in an attempt to reduce the foaming created by the carbonated water in the drink.

Thus, as water or other diluent is dropped from an outlet of the diluent conduit from the dispenser head into the spout 34, it cascades over the diffuser 46 or 48. In the case of the embodiment illustrated in FIG. 3, the water diluent somewhat mixes with the syrup concentrate emitted from skirt apertures 54 as it passes over the skirt 52 and apertured rings 62 and 64 and eventually through the spout 34 and into the cup 68. In the case of the embodiment illustrated in FIG. 4, the concentrate is emitted through the apertures 60 so as to somewhat mix with the water diluent as it passes through the spout. However, in either case, it has been found that the syrup concentrate and water diluent mix most substantially in the cup 16 itself. In any event, while performing adequately well for soft drinks and juice drinks, such as lemonade and the like, this design does not froth or whip the beverage. To create a frothed or whipped beverage requires turbulent mixing of the water diluent and syrup concentrate so as to entrain air bubbles therein. Moreover, the syrup concentrate must be prone to such whipping, such as Orange Bang, Inc.'s Orange Bang®, Piña Colada Bang®, and Strawberry Bang® beverages. Frothed or whipped beverages are more foaming than carbonated or non-whipped drinks and require a special syrup capable of being whipped.

In the early 1980's, Orange Bang, Inc. designed a dispenser 100 for a whipped beverage comprising a specially designed plastic mixing block 102, as shown in FIG. 5. The mixing block 102 included a generally hemispherically shaped mixing chamber 104 cut-out therefrom. A syrup concentrate conduit 106 was formed in the block 102 such that it extended between the mixing chamber 104 and a solenoid valve 108 which controlled the delivery of the pressurized syrup concentrate. Similarly, a conduit 110 was formed in the block 102 which was in fluid communication with the mixing chamber 104 and another solenoid valve 112 for controlling the amount of pressurized water which was delivered. The concentrate and water conduits 106 and 110 were angled with respect to one another such that the syrup and water would be ejected at angles which would intersect at a given point to create the frothed beverage. It was discovered that the mixing chamber 104 had to be vented to allow air to be introduced into the mixing chamber 104 and allow the concentrate and water to whip or froth. It was discovered that the mixing chamber 104 had to be vented to allow air to be introduced into the mixing chamber 104 and allow the concentrate and water to whip or froth. Accordingly, a vent conduit 114 was formed in the block 102. It was also found that whip-gain was improved and the possibility of the beverage entering the vent conduit 114 virtually eliminated by the addition of a metal tube 116 within the vent conduit 114 and extending into the water conduit 114. As the water cascaded over the end of the tube 116, a venturi effect was created allowing air to be drawn into the water stream, while preventing the back flow of beverage through the air vent 114 and out of the exterior of the block 102 of the dispenser 100. Other conduits 118 such as for electrical leads, stream control devices, etc. were formed in the mixing block 102.

U.S. Pat. No. 4,676,401 to Fox et al. discloses an improvement on this design, wherein a mixing paddle operated by a motor is introduced into the mixing chamber to improve the whip-gain of the whipped beverage.

U.S. Pat. No. 6,305,269 to Stratton, discloses a slight variation to the initial Orange Bang, Inc. beverage dispenser. To improve whip-gain, Stratton discloses the use of a uniquely configured water injection nozzle having a tube with a flattened end portion defining an elongated water injection port extending into the mixing chamber. Such specialized water injection nozzle provided sufficient whip-gain. However, this dispensing apparatus also required a specially designed plastic mixing block with the various passage-ways, chambers, air vents, etc.

Another problem with all of these devices is that, due to their specialized design, they effectively served as a stand-alone dispenser. This required that the establishment make room for the dispenser next to traditional carbonated beverage dispensing banks, as illustrated in FIGS. 1 and 2 and described above.

Accordingly, there is a continuing need for an apparatus which can be incorporated into a traditional bank of post-mix soft drink dispenser heads which will prepare and dispense whipped beverages. Such an apparatus, or modified dispenser head, should not require the use of specialized equipment, such as plastic mixing blocks, vented chambers, motorized mixing paddles or the like. The present invention fulfills these needs, and provides other related advantages.

SUMMARY OF THE INVENTION

The present invention resides in a post-mix beverage dispenser for whipped or frothed beverages. The beverage dispenser of the present invention does not require specialized equipment, such as plastic mixing blocks drilled or cut to have the necessary air vents, conduits and chambers formed therein, flattened tubes, or motorized mixing paddles. Instead, the dispenser preferably modifies a conventional dispensing head to accomplish the present invention.

Typically, the dispenser head includes an outlet spout attached thereto and which cooperatively define the mixing chamber. Preferably, the spout is removably attached to the head, in standard fashion, to facilitate the cleaning of the spout and the upper portion of the mixing chamber. The head includes inlet conduits fluidly connected to the sources of diluent and concentrate, and valves for controlling the flow of diluent and concentrate from the inlet conduits to the mixing chamber. A switch selectively operates the valves.

In one embodiment, a jet is in fluid communication with a source of diluent and configured to spray the diluent out over a wide area towards the wall of the mixing chamber. Typically, the jet includes an elongated and narrow aperture. A concentrate dispensing outlet in fluid communication with the source of concentrate ejects concentrate into the mixing chamber causing turbulent mixing of the diluent and concentrate to create the frothed or whipped beverage.

In the present invention, the jet is configured so as to be inserted into the diluent outlet so as to extend into the mixing chamber, defined by the dispenser head and attached spout. The jet includes an aperture configured to spray the diluent towards the wall of the mixing chamber, generally opposite the jet, and in a direction generally transversed to a longitudinal access of the jet. Typically, the jet aperture comprises either an elongated and narrow opening or a series of generally aligned apertures formed in a side wall of the jet body to create the desired spray effect. Typically, the jet is removably inserted into the diluent outlet.

A diffuser, comprising a plate having a plurality of apertures, is disposed within the spout below the jet. This enables sufficient air to be introduced into the mixing chamber, while simultaneously delivering the frothed beverage out of the spout and into the customer's cup. Typically, the plate is generally circular and of generally uniform thickness.

In another embodiment, the diffuser includes a hollow shaft having an end insertable to a concentrate dispensing outlet of the dispenser head. The plate extends outwardly from the shaft, typically at an end opposite the end of the shaft insertable into the outlet. In this embodiment, as the diffuser is fluidly connected to the concentrate dispensing outlet, the diffuser includes an outlet for emitting concentrate into the mixing chamber.

In one embodiment, the diffuser outlet comprises an aperture formed in the hollow shaft. Preferably, the aperture comprises an elongated slit.

In another embodiment, a skirt extends outwardly from the shaft, above the plate, and has a diameter less than that of the plate. The diffuser outlet is formed in the skirt, and typically includes a plurality of spaced apart apertures formed therein so as to be in fluid communication with the hollow shaft.

It has been found that the aforementioned arrangements allow the use of traditional dispensing heads which are modified only slightly to froth or whip the beverage. Furthermore, there is no need for air passageways to create venturi effects or other specialized equipment.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
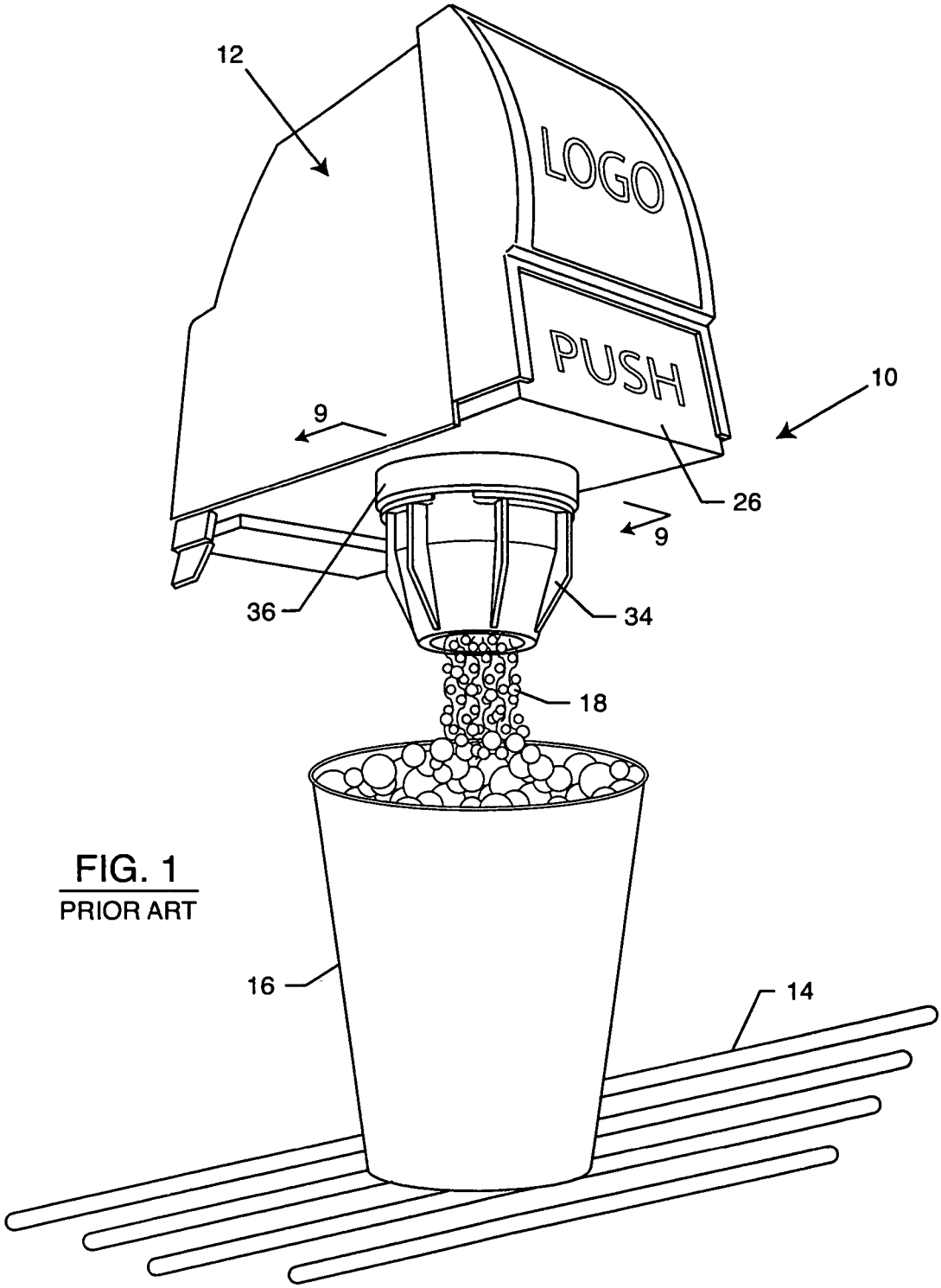
FIG. 1 PRIOR ART
FIG. 1 is a partially fragmented perspective view of a conventional prior art post-mix beverage dispenser head delivering a beverage into a cup.
Figure 2:
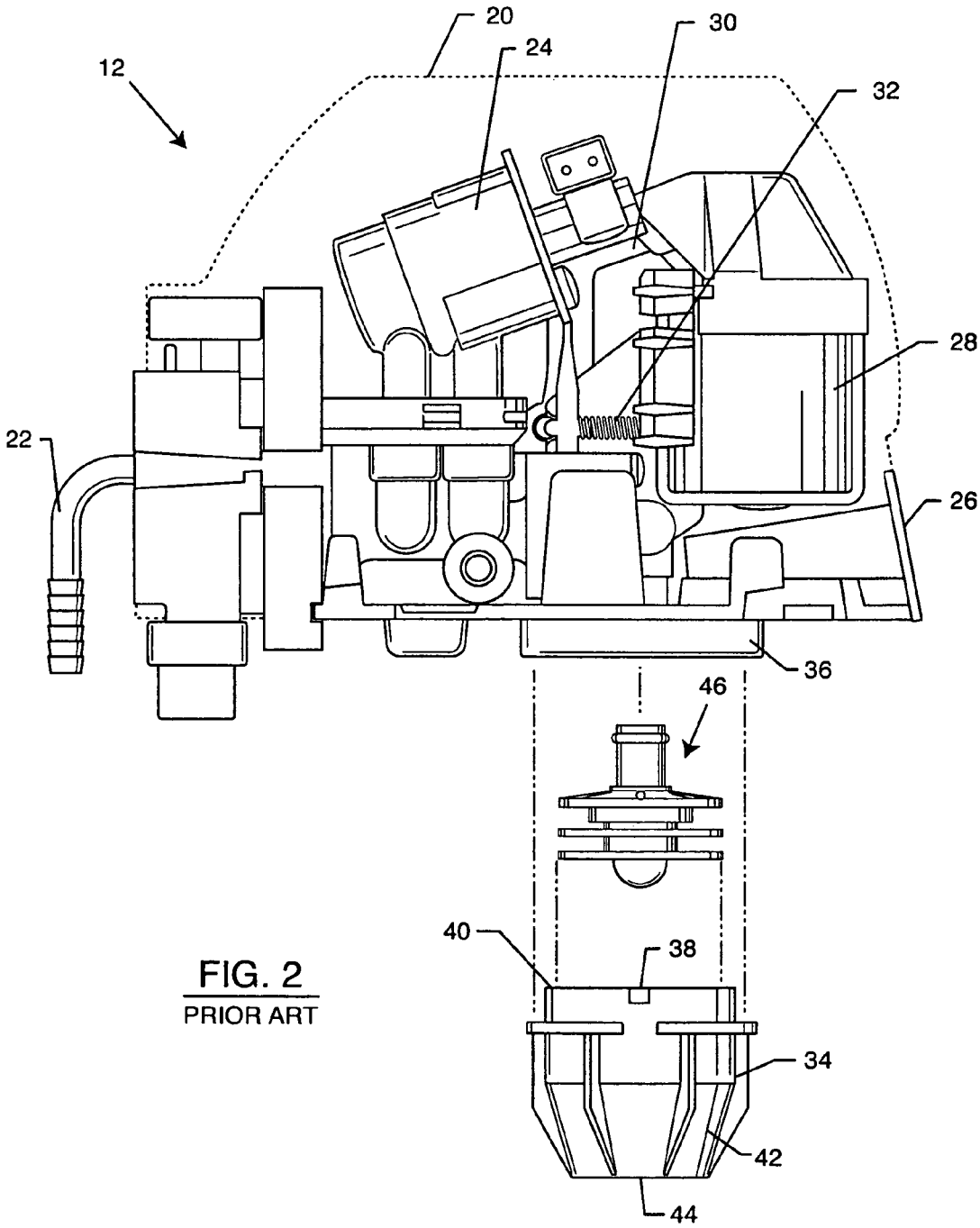
FIG. 2 PRIOR ART
FIG. 2 is a partially exploded side perspective view of the beverage dispenser of FIG. 1, illustrating a cover thereof in phantom.
Figure 3:
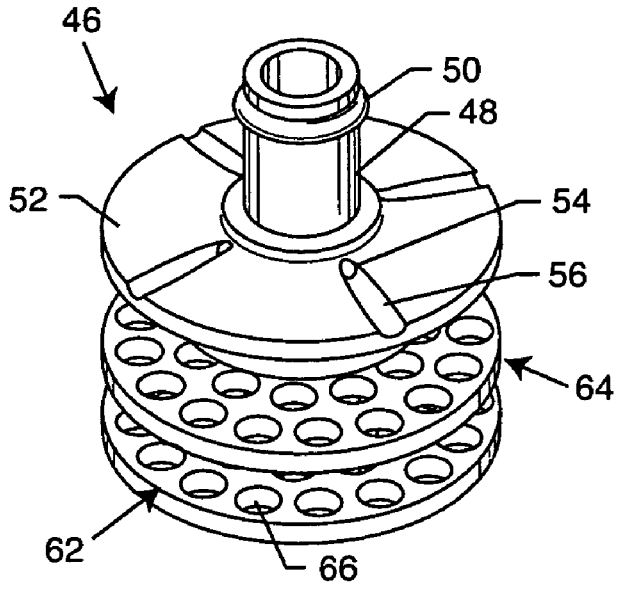
FIG. 3 PRIOR ART
FIG. 3 is a perspective view of a prior art diffuser.
Figure 4:
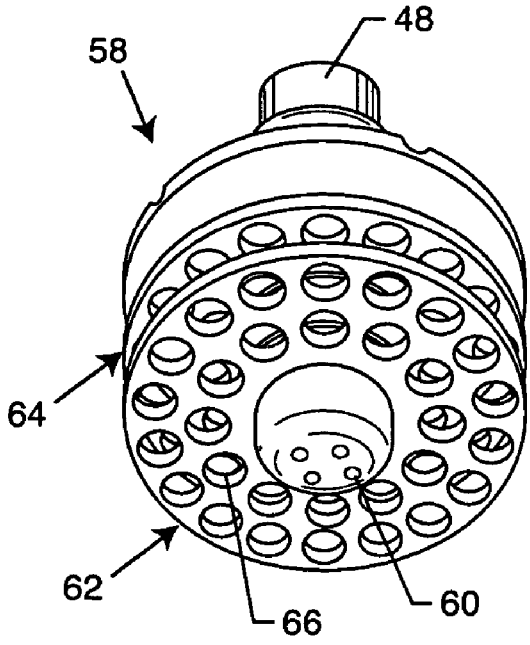
FIG. 4 PRIOR ART
FIG. 4 is a bottom perspective view of another prior art diffuser.
Figure 5:
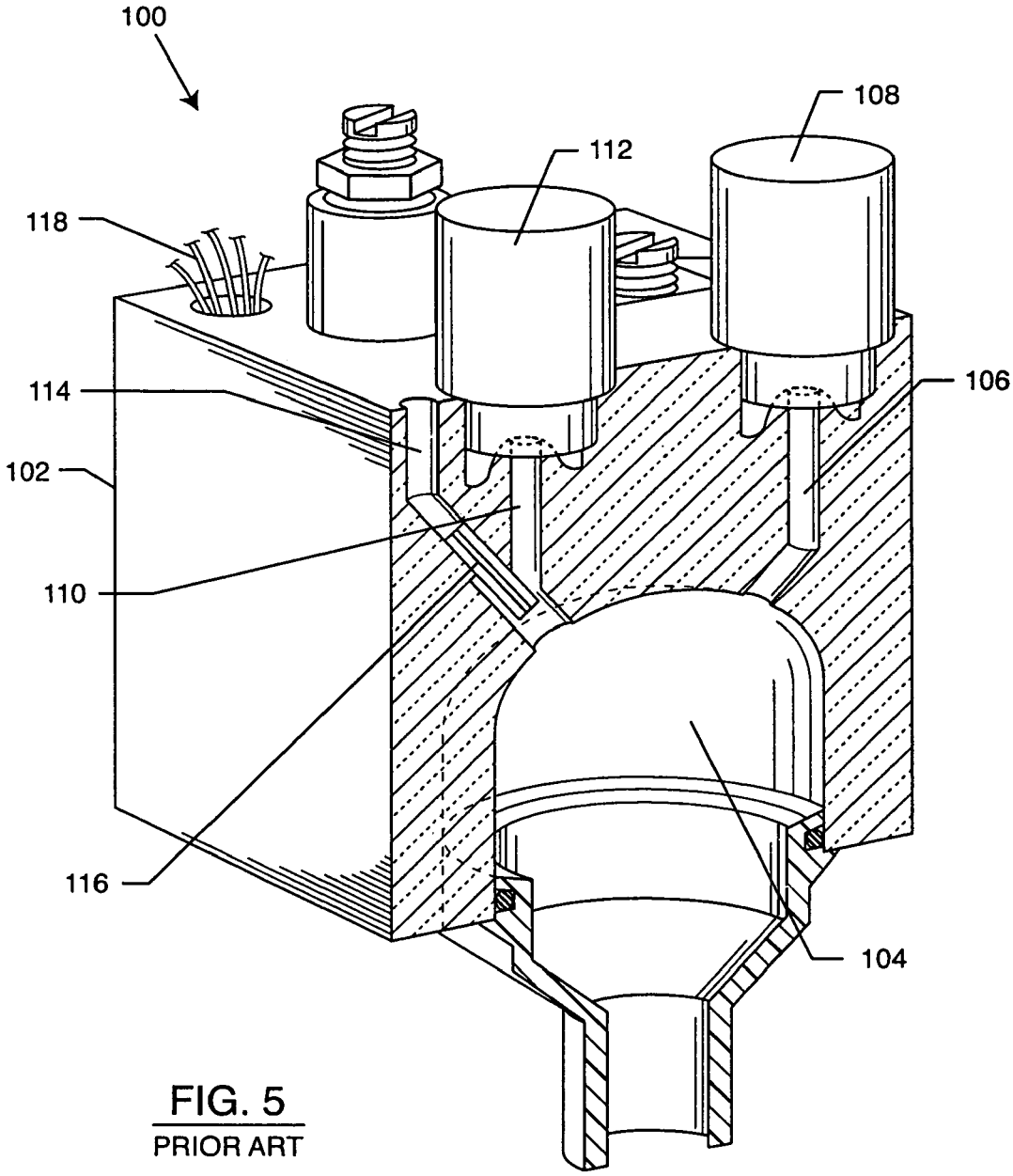
FIG. 5 PRIOR ART
FIG. 5 is a partially sectioned perspective view of a prior art specialized mixing block and dispenser apparatus.

As shown in the accompanying drawings for purposes of illustration, the present invention resides in a post-mix beverage dispenser, which adds new and modified components to conventional beverage dispenser heads to create a frothed beverage in accordance with the present invention.

It was found by the inventor that if various modifications were made to the conventional dispenser 10, a frothed drink could be created with the appropriate syrup. The first necessary addition, referring to FIG. 6, was the inclusion of a jet member 200 which was inserted into the diluent conduit 68 outlet. Thus, instead of dropping the water diluent downwardly, the water diluent could be directed towards an inner-surface 70 of the outer wall 36 and an inner-surface 72 of the upper portion of the spout 34. These inner surfaces 70 and 72 or what is referred to herein as the "mixing chamber".

Currently pending patent application Ser. No. 10/454,453 (the contents of which are hereby incorporated herein) discloses the use of such water jets. However, in that application, the water jet must be disposed at a given angle so as to hit the inner surfaces 70, 72 tangentially so as to create a swirling mass, or directed opposite the concentrate outlet so that the water and syrup collide. In practice, it has been found that this is not very feasible, as the water jet 200 is difficult to install at these selected angles, and perhaps more importantly the diffuser is typically re-inserted in a haphazard manner.

Figure 9:
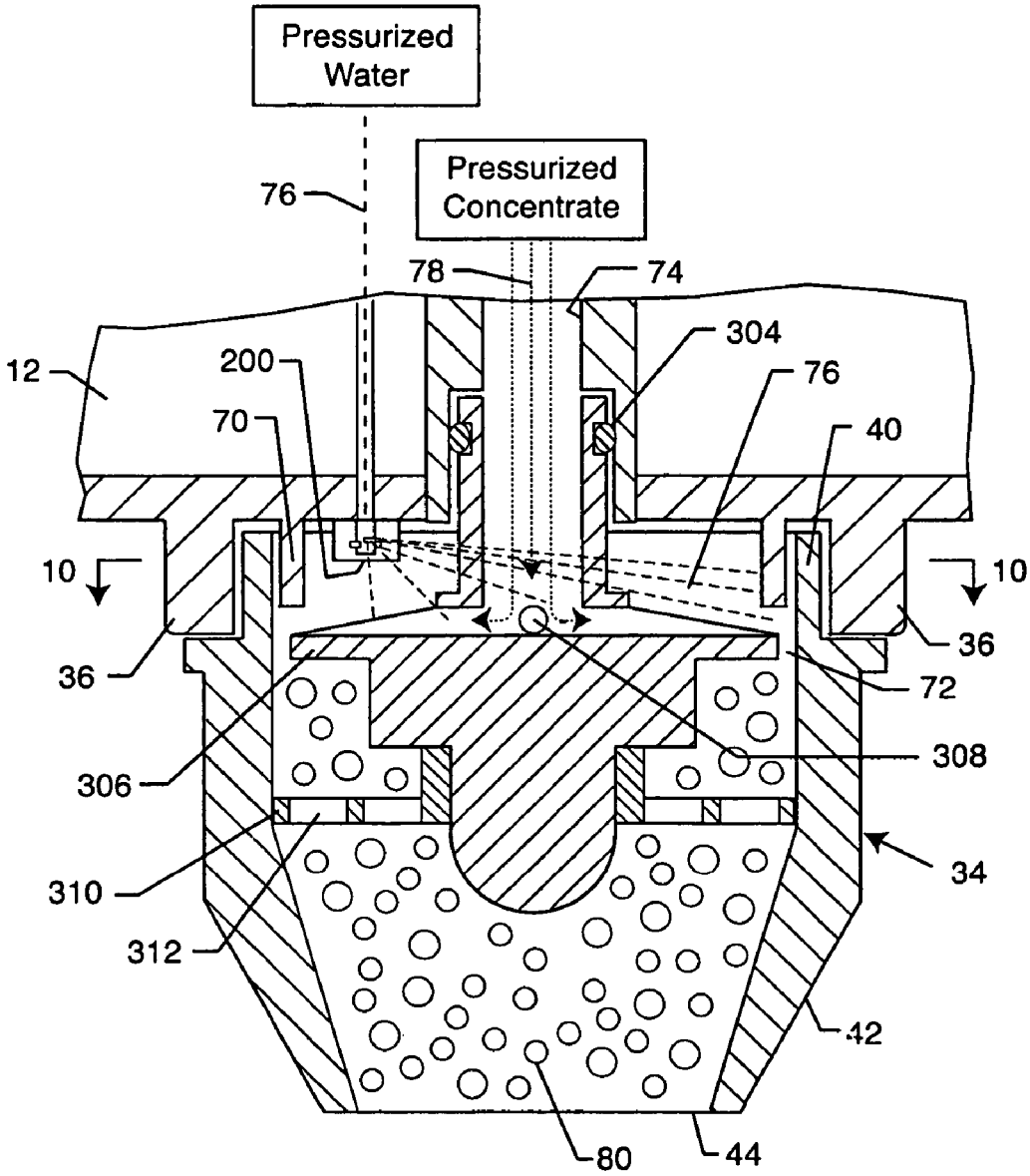
FIG. 9 is a cross-sectional view taken generally along line 9—9 of FIG. 1, but incorporating the jet and diffuser of the present invention so as to create a frothed beverage.

Thus, the water jet 200 has been modified in the present invention. In particular, the water jet 200 includes a closed-end generally tubular member 202 having an opening or inlet 204 in fluid communication with the diluent conduit 68. An elongated and narrow aperture 206 is formed in a lower portion of the tubing 202 such that a pressurized stream of water diluent is sprayed from the water jet 200 and into the mixing chamber so as to hit the wall surfaces 70 and 72, as illustrated in FIG. 9, and as will be described more fully herein. Projections 208 preferably extend from the tube 202 so as to facilitate insertion of the water jet 200 into the outlet of the diluent conduit 68, and also so as to ensure that the water jet 200 is not inserted too deeply into the water conduit 68 such that the aperture 206 extends into the mixing chamber.

Figure 7:
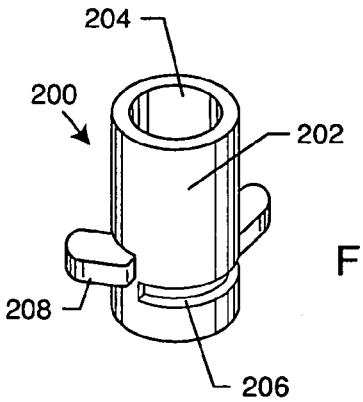
FIG. 7 is a front perspective view of a jet used in accordance with the present invention.
Figure 8:
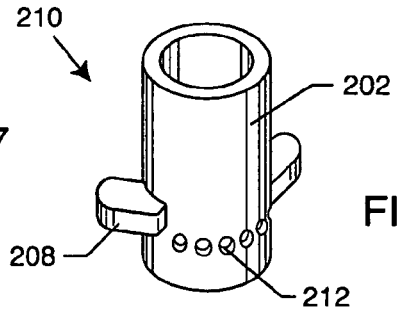
FIG. 8 is a front perspective view of another jet used in accordance with the present invention.

With reference to FIG. 8, another water jet 210 is illustrated wherein instead of a single elongated and narrow aperture 206, a plurality of apertures 212 are formed in a generally aligned fashion as illustrated. Similarly, the elongated and narrow aperture 206 of FIG. 7 could have one or more cross-beams or barriers so as to create multiple slits. The important aspect of the present invention is that the jet 200 include an aperture configured such so as to spray the diluent over a wide angle and preferably with a relatively high velocity onto the surfaces 70 and 72 of the mixing chamber. As such, the diluent is typically sprayed in a generally arched pattern so as to contact as much of the inner surfaces 70 and 72 as possible.

Referring again to FIG. 6, it was found that even with the installed jet 200, the design of the prior art diffusers 46 and 58 prevented the proper whipping or frothing of the beverage. Accordingly, the inventor created a new diffuser 300 having a hollow post 302 adapted to be inserted into the outlet 74 of the concentrate conduit of the dispenser head 12. Preferably, the hollow tube 302 includes a sealing means, such as the illustrated O-ring 304. This ensures a tight and leak-free fit with a dispenser head 12. It was found that if the skirt 306 was reduced in diameter, whipping gain was improved. In the embodiment illustrated in FIG. 6, the diffuser outlets 308 are formed through the skirt 306 and into the hollow tube 302 so as to emit the concentrate therethrough and towards the inner surfaces 70 and 72, as will be more fully discussed herein.

It was also found that a single ring or plate 310 having a plurality of apertures 312 formed therethrough enables the beverage to become frothy and whipped. Thus, the additional plates or rings were removed as these interfered with the whipping process. The plate 310, as illustrated in FIG. 6, is of greater diameter than the skirt 306, generally planar and typically circular so as to fit within the spout 34.

Figure 6:
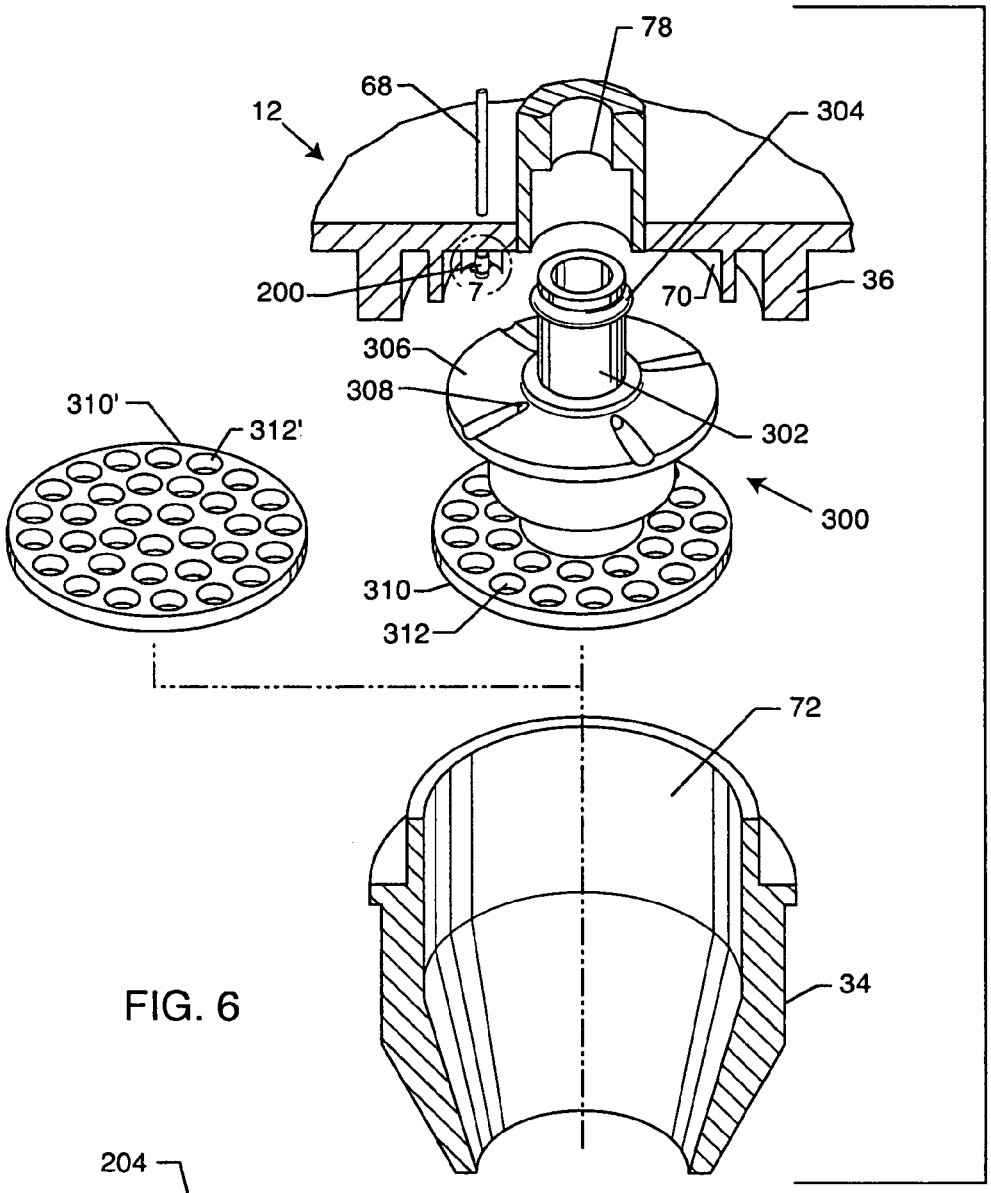
FIG. 6 is a partially fragmented and exploded view of a jet and diffusers embodying the present invention and incorporated into a conventional post-mix beverage dispenser head, in accordance with the present invention.

With continuing reference to FIG. 6, it has been found that a single plate 310' having a plurality of apertures 312', typically at least eight or more apertures, can alone act as the diffuser. In this case, the plate diffuser 310' would be inserted, or otherwise disposed, in the spout 34. The syrup concentrate would exit the outlet 78 of the dispenser head 12. The non-carbonated diluent, typically water, would be emitted from the jet 200 such that the diluent is sprayed in a horizontal direction or a direction generally transverse to the longitudinal access of the body 202 of the jet 200 so as to contact the stream of concentrate exiting from the concentrate outlet 78. This violent collision, due to the high velocity of the diluent emitted from the jet 200, creates turbulence and entrains air in the syrup and water mixture. As discussed above, the diluent is non-carbonated and the syrup concentrate is of the appropriate composition so as to be capable of being whipped or frothed. Typical carbonated drinks are not capable of being frothed.

Due to the multiple apertures 312' in the diffuser plate 310', the frothed beverage is allowed to exit through some of the apertures 312', while air is allowed to enter into the mixing chamber through other aperture 312'. This same principal applies to the plate 310 which extends from the hollow tube 302 of the other diffuser embodiments wherein the syrup concentrate is directed from the concentrate conduit outlet 78 to other outlets in the diffuser.

However, the implementation of a single diffuser plate 310' enables the implementation of the present invention into a new generation of dispenser heads having a plurality of syrup concentrate dispensing outlets for different syrup concentrates. The non-carbonated diluent jet 200 would have its aperture 206 directed to one or more streams of the syrup concentrate. Of course, this arrangement can also be used in a dispenser head 12 emitting only a single syrup concentrate as well.

Figure 10:
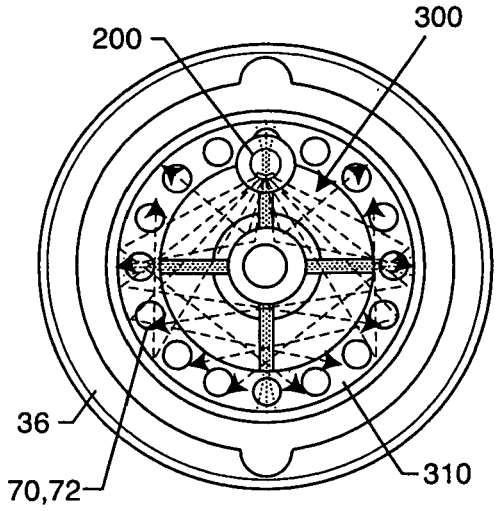
FIG. 10 is a top plan section view taken along line 10—10 of FIG. 9, illustrating the flow of diluent and concentrate in a mixing chamber of the dispenser, in accordance with the present invention.

With reference now to FIGS. 9 and 10, with the water jet 200 inserted into the outlet of the diluent conduit 68 and the diffuser 300 properly inserted in the concentrate outlet 74, the diluent 76 is sprayed outwardly generally towards the walls or inner surfaces 70 or 72 of the mixing chamber, and also hits the exposed surfaces of the diffuser 300. As illustrated in FIG. 10, the spray forms a generally arcuate pattern so as to expand outwardly away from the water jet 200 and thus hit a large surface area of the surfaces 70 and 72. Simultaneously, the concentrate 78, illustrated by the dotted line, is ejected out of the spaced-apart outlet 308 of the skirt 306. The result is that the sprayed water diluent 76 and concentrate 78 collide with one another either midstream or after colliding with the inner surface walls 70 and 72 of the mixing chamber. The diluent and concentrate 76 and 78 collide with sufficient force and turbulent nature so as to entrain air bubbles therein and create a frothed beverage 80 which falls through the apertured plated ring 310 and out the outlet 44 of the spout 34. Thus, by inserting the water jet 200 and modified diffuser 300, a whipped and frothed beverage can be created using conventional dispensers 10. It should be noted that the orientation of the syrup concentrate outlet does not matter as a frothed beverage is created regardless.

Figure 11:
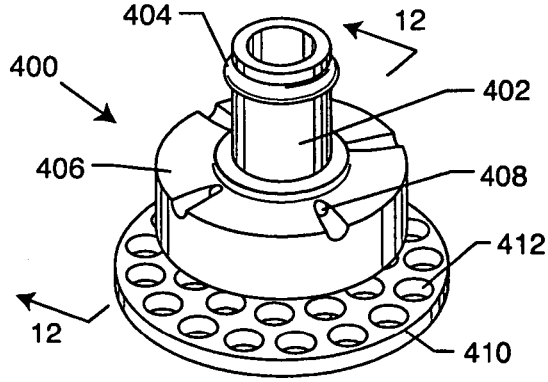
FIG. 11 is a front perspective view of another diffuser embodying the present invention.
Figure 12:
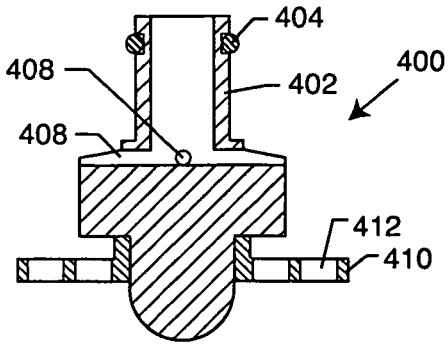
FIG. 12 is a cross-sectional view taken generally along line 12—12 of FIG. 11.
Figure 13:
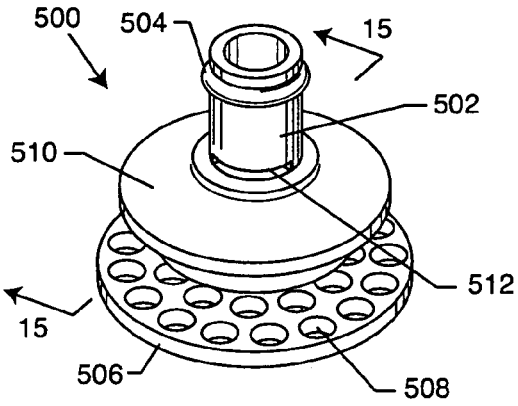
FIG. 13 is a front perspective view of another diffuser embodying the present invention.
Figure 14:
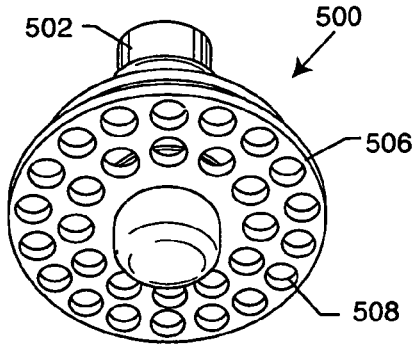
FIG. 14 is a bottom perspective view of the diffuser of FIG. 13.
Figure 15:
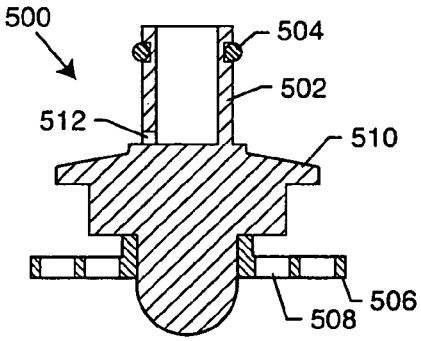
FIG. 15 is a cross-sectional view taken generally along line 16–15 of FIG. 13.

With reference now to FIGS. 11 and 12, another diffuser 400 is illustrated which is similar to that illustrated in FIG. 6. The diffuser 400 also includes a hollow tube 402 to with an O-ring seal 404 or the like, as well as a skirt 406 having a plurality of outlets 408, typically spaced apart from one another and in fluid communication with hollow tube 402 so as to emit concentrate therefrom. However, in this case, the skirt 406 is of further reduced diameter with respect to the bottom plate 410, as compared to the skirt 306 of FIG. 6. It has been found that reducing the diameter of the skirt 406 increases the "gain" or whipping of the beverage, requiring less concentrate.

With reference now to FIGS. 13–16, yet another diffuser 500 is illustrated. This diffuser, also includes a hollow tube 502 in fluid communication with the concentrate outlet such that concentrate flows therethrough and a seal 504, such as the illustrated O-ring. This diffuser 500 also includes a lower ring or plate 506 having a plurality of apertures 508 formed therein, as discussed above. The diffuser 500 also includes a skirt 510 of reduced diameter as compared to the ring 506. However, in this case, the diffuser outlets are not formed in the skirt 510. Instead, an elongated aperture in the form of a slit 512 is formed directly in the hollow tube 502.

Figure 16:
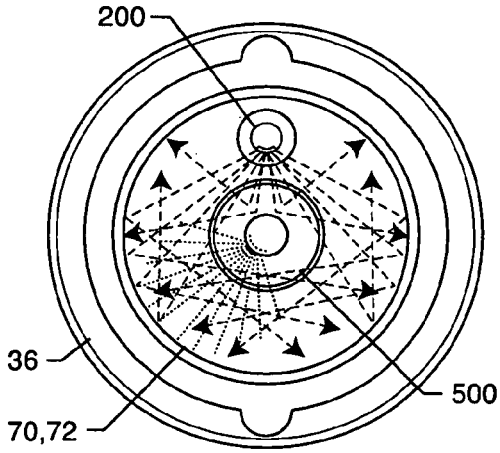
FIG. 16 is a diagrammatic view illustrating the paths taken by diluent and concentrate, using the diffuser of FIG. 13, in accordance with the present invention.

With particular reference to FIG. 16, the jet 200 is installed in the diluent outlet 68, as described above, and sprays diluent (shown by the dashed lines) outwardly, so as to hit the inner surfaces 70 and 72 of the mixing chamber in a violent and turbulent manner. It has been found that incorporating the elongated aperture 512 into the hollow tube 502 creates an arcuate spray of concentrate 78 (illustrated by the dotted lines in FIG. 16) that along its path collides with streams of diluent and also impact a portion of the inner surfaces 70 and 72. The benefit of incorporating the slit or elongated aperture 512 is that the aperture 512 need not be oriented towards the jet 200 whatsoever. A sufficient whipping gain is obtained regardless, and in fact the whipping gain is actually improved as compared to the embodiments illustrated in FIGS. 6 and 11, wherein the outlets extend from the skirt. It is believed that this is due to the "spray" effect of the elongated slit 512.

Figure 17:
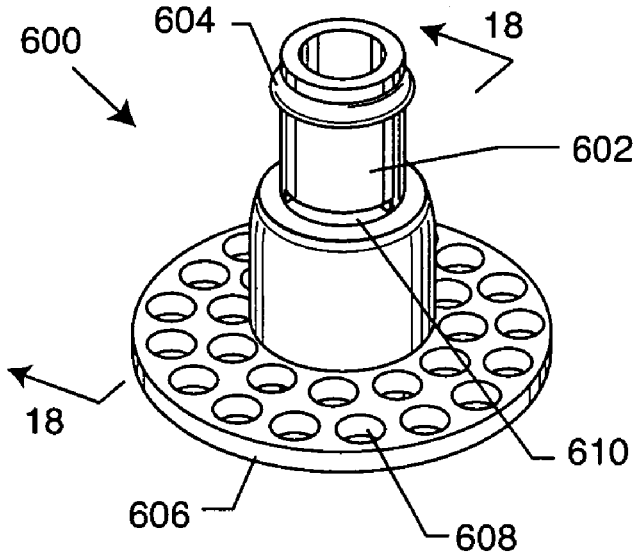
FIG. 17 is a front perspective view of another diffuser embodying the present invention.
Figure 18:
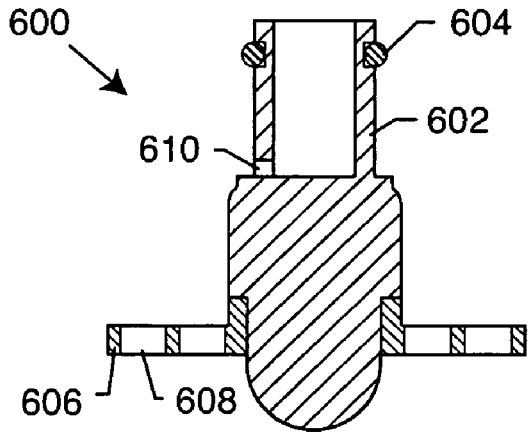
FIG. 18 is a cross-sectional view taken generally along line 18—18 of FIG. 17.

With reference now to FIGS. 17 and 18, yet another diffuser 600 embodying the present invention is illustrated. Similar to that above, the diffuser 600 includes a hollow tube 602 in fluid communication with the concentrate outlet 74 and having an O-ring 604 or the like to secure the connection and provide a leak-proof seal. A lower plate 606 extends outwardly and has a plurality of apertures 608 formed therein such that the frothed drink 80 can fall therethrough. In this case, however, the skirt is significantly reduced so as to be virtually non-existent. It has been found that the skirt is actually not necessary, particularly when the elongated aperture or slit 610 is formed in the hollow post 603.

The method of mixing is similar to that illustrated and described with respect to FIG. 16. Of particular advantage of the present invention is that the jet 200 can be installed so as to extend into the mixing chamber and the slit 206 or aperture 212 thereof directed into the mixing chamber. As the diffuser and spout are typically removed each night for cleaning, when they are reconnected to the dispenser head 12, the diffuser 300, 400, 500 or 600 can be installed in any orientation and a frothed drink still created.

It will be appreciated by those skilled in the art that the above-described invention enables the creation of frothed drinks in conventional dispensing equipment 10, so as to eliminate the need for specialized dispensers having plastic blocks with vent tubes, paddles, etc., therein. Thus, the end user need not provide the specialized equipment in addition to the conventional dispensing equipment. Instead, the frothed beverage of the present invention can be created in the conventional manner by supplying a bag in a box, for example, connected to the dispenser's concentrate conduit 74. With the addition of the jet 200 and diffusers 300–600, a whipped drink with sufficient gain or froth is created within a single head 12 of the dispenser bank. Similar to traditional dispenser heads 12, to clean the dispenser 10, one merely needs to remove the spout 34 and diffuser 300–600, which can be washed separately, and wipe the bottom portion of the head 12 with a wash cloth or the like.

Although several embodiments have been described in detail for purposes of illustration, various modifications may be made without departing from the scope and spirit of the invention. Accordingly, the invention is not to be limited, except as by the appended claims.

What is claimed is:

1. A post-mix beverage dispenser head for creating a frothed beverage, comprising:

a spout attached to the dispenser head and cooperatively defining a mixing chamber having an inner wall;

a jet disposed within a diluent outlet of the dispenser head so as to be in fluid communication with the diluent and extend into the mixing chamber, the jet including an aperture configured to spray the diluent towards the wall of the mixing chamber generally opposite the jet, wherein the jet comprises a body configured to be inserted into the diluent outlet, and wherein the aperture is formed in a side wall thereof so as to emit the diluent generally transverse to a longitudinal axis thereof;

a concentrate dispensing outlet in fluid communication with a source of beverage concentrate and positioned to eject concentrate into the mixing chamber such that the concentrate collides with the diluent spray to create a frothed beverage; and a diffuser disposed in the spout below the jet.

2. The dispenser head of claim 1, wherein the dispenser head includes conduits fluidly connected to the sources of diluent and concentrate, and valves for controlling the flow of diluent and concentrate from the conduits to the mixing chamber.

3. The dispenser head of claim 1, wherein the jet is removably inserted into the diluent conduit outlet.

4. The dispenser head of claim 1, wherein the jet aperture comprises an elongated and narrow aperture.

5. The dispenser head of claim 1, wherein the jet aperture comprises a series of generally aligned apertures.

6. The dispenser head of claim 1, wherein the diffuser comprises a plate having a plurality of apertures therethrough.

7. The dispenser head of claim 6, wherein the diffuser further comprises a hollow shaft extending from the plate and having an end insertable into the concentrate dispensing outlet, and an outlet for emitting concentrate into the mixing chamber.

8. The dispenser head of claim 7, wherein the plate extends outwardly from the shaft.

9. The dispenser head of claim 6, wherein the plate is generally circular and of generally uniform thickness.

10. The dispenser head of claim 8, including a skirt extending outwardly from the shaft above the plate and having a diameter less than that of the plate.

11. The dispenser head of claim 10, wherein the diffuser outlet is formed in the skirt so as to be in fluid communication with the hollow shaft.

12. The dispenser head of claim 11, wherein the outlet comprises a plurality of spaced apart apertures formed through the skirt and in fluid communication with the hollow shaft.

13. The dispenser head of claim 7, wherein the diffuser outlet comprises an aperture formed in the hollow shaft.

14. The dispenser head of claim 13, wherein the aperture comprises an elongated and narrow aperture.

15. The dispenser head of claim 1, wherein the jet body comprises a tube having an open end insertable into the diluent outlet, and closed end.

16. A post-mix beverage dispenser head for creating a frothed beverage, comprising:

a mixing chamber defined by an outlet spout attached to the dispenser head, the dispensing head including inlet conduits fluidly connected to sources of diluent and concentrate, and valves for controlling the flow of diluent and concentrate from the inlet conduits to the mixing chamber;

a jet extending from the diluent conduit and into the mixing chamber, the jet including an aperture formed in a sidewall thereof and configured to spray the diluent towards a wall of the mixing chamber generally opposite the jet; and a diffuser having a hollow tube in fluid communication with the beverage concentrate conduit, a plate extending from the shaft and having a plurality of apertures formed therein, and an outlet formed in the diffuser above the plate for ejecting concentrate into the mixing chamber such that the concentrate collides with the diluent spray to create a frothed beverage.

17. The dispenser of claim 16, wherein the jet is configured to be removably inserted into the outlet of the diluent conduit, and wherein the aperture comprises an elongated aperture or series of apertures formed in a the side wall thereof so as to spray the diluent in a generally horizontal direction.

18. The dispenser of claim 17, wherein the diffuser is removably inserted into the outlet of the concentrate conduit.

19. The dispenser of claim 16, including a skirt extending outwardly from the shaft above the plate and having a diameter less than that of the plate.

20. The dispenser of claim 19, wherein the diffuser outlet is formed in the skirt and in fluid communication with the hollow shaft.

21. The dispenser of claim 20, wherein the diffuser outlet comprises a plurality of spaced apart apertures formed in the skirt and in fluid communication with the hollow shaft.

22. The dispenser of claim 16, wherein the diffuser outlet comprises an elongated aperture formed in the hollow shaft.

23. A diffuser for use in a post-mix beverage dispenser head having an outlet spout attached to a dispensing head, the dispensing head including conduits fluidly connected to sources of diluent and concentrate, and valves for controlling the flow of diluent and concentrate from the conduits, the diffuser comprising:

a hollow shaft having an open end insertable into the concentrate dispensing outlet;

a single plate extending outwardly from the shaft adjacent to an opposite closed end thereof, the plate having a plurality of apertures formed therein; and an outlet formed in the hollow shaft above the plate for emitting the concentrate for mixing with the diluent.

24. The diffuser of claim 23, wherein the plate is generally circular and of generally uniform thickness.

25. The diffuser of claim 23, including a skirt extending outwardly from the shaft above the plate and having a diameter less than that of the plate.

26. The diffuser of claim 25, wherein the diffuser outlet comprises a plurality of spaced apart apertures formed in the skirt and in fluid communication with the hollow shaft.

27. The diffuser of claim 23, wherein the diffuser outlet comprises an elongated aperture formed in the hollow shaft.

28. A diffuser for use in a post-mix beverage dispenser head having an outlet spout attached to a dispensing head, the dispensing head including conduits fluidly connected to sources of diluent and concentrate, and valves for controlling the flow of diluent and concentrate from the conduits, the diffuser comprising:

a central hollow shaft defining a bore extending therewithin that terminates in a closed end, an open end of the shaft insertable into the concentrate dispensing outlet such that the concentrate flows into the bore;

a plate defining a plurality of apertures extending outwardly from the shaft in spaced relation to the open end of the shaft; and a concentrate outlet formed in the hollow shaft, so as to fluidly communicate with the bore, above the plate for emitting the concentrate for mixing with the diluent, such that the diluent impinges upon the concentrate in a turbulent manner to create a fluid-foam mixture before the mixture passes over the plate and dispensed through the outlet spout.

29. The diffuser of claim 28, including a skirt extending outwardly from the shaft above the plate and having a diameter less than that of the plate.

30. The diffuser of claim 29, wherein the diffuser outlet comprises a plurality of spaced apart apertures formed in the skirt and in fluid communication with the bore of the hollow shaft.

31. The diffuser of claim 28, further including a jet seated within the diluent outlet, the jet including a diluent inlet for receiving diluent from the diluent outlet, and a diluent outlet such that the diluent exits the outlet at an increased velocity in relation to that at which it flows through the diluent outlet.

* * * * *